US006059134A

United States Patent [19]

Long, Jr.

[11] Patent Number: 6,059,134

[45] Date of Patent: May 9, 2000

[54] SNAP-ON SCREW-OFF CLOSURE FOR USE IN COMBINATION WITH A CONTAINER

[75] Inventor: Charles C. Long, Jr., New Castle, Pa.

[73] Assignee: International Plastics and Equipment Corporation

[21] Appl. No.: 08/961,440

[22] Filed: Oct. 30, 1997

[51] Int. Cl.[7] ..... B65D 41/34

[52] U.S. Cl. ..... 215/252; 215/318; 215/341; 215/329; 215/44; 215/45; 220/296

[58] Field of Search ..... 215/354, 318, 215/252, 253, 320, 355, 321, 341, 343, 344, 44, 45, 329; 220/296, 796, 801, 802

[56] References Cited

U.S. PATENT DOCUMENTS

| | | | |
|---|---|---|---|
| 4,448,319 | 5/1984 | Kern | 215/318 X |
| 5,271,512 | 12/1993 | Ekkert . | |
| 5,450,972 | 9/1995 | Zemlo | 215/318 X |
| 5,480,045 | 1/1996 | Molinaro et al. | 215/318 X |
| 5,685,443 | 11/1997 | Taber et al. | 215/318 X |
| 5,699,924 | 12/1997 | Mascio et al. | 215/252 |

FOREIGN PATENT DOCUMENTS

| | | | |
|---|---|---|---|
| 1298166 | 5/1962 | France | 215/252 |
| 9623699 | 8/1996 | WIPO . | |
| 9738912 | 10/1997 | WIPO . | |

*Primary Examiner*—Allan N. Shoap
*Assistant Examiner*—Robin A. Hylton
*Attorney, Agent, or Firm*—Cohen & Grigsby, P.C.

[57] ABSTRACT

A closure is provided with a thread configuration adapted for snap-on or screw-on application to a container neck finish. Preferably the closure and neck finish contain eight or nine mating continuous or discontinuous threads for this purpose. The present invention preferably provides at least one annular sealing bead depending from the outer surface of the closure valve which are compressed against the inner surface of the container neck to form a seal as the closure is snapped onto the container neck. Optionally, sealing engagement between the closure and the mating portions of the exterior wall of the container neck may be further improved by including one or more annular sealing beads on the interior surface of the closure depending annular skirt. The present invention also preferably provides plurality of elevated areas extend upwardly from the tamper-evident band in spaced relation to the bottom edge of the closure body to support the tamper evident band in resisting vertical movement imparted by insertion of the closure on the bottle neck, thereby protecting the frangible elements during assembly. The frangible elements connecting the tamper-evident band to the lower edge of the closure body may be configured to extend from these elevated areas as well as the non-elevated areas of the tamper-evident band to assist in preventing axial misalignment of the tamper-evident band relative to the annular depending skirt portion of the closure upon subjecting the closure to torquing forces during assembly to the container neck. At least one and preferably a plurality of circumferentially spaced lugs optionally extend from the exterior wall of the container neck to facilitate breaking the frangible elements on the tamper-evident band of the closure by engaging the frangible elements as the closure is twisted off the container neck following initial snap-on application.

18 Claims, 3 Drawing Sheets

SNAP-ON SCREW-OFF CLOSURE FOR USE IN COMBINATION WITH A CONTAINER

RELATED APPLICATIONS

One family of related patent applications assigned to the assignee of the present application include the U.S. patent application filed Oct. 8, 1997 under attorney docket no. 96-024 CCC (serial no. to be assigned), which is a continuation-in-part of U.S. patent application Ser. No. 08/927,311 filed Sep. 11, 1997, which is a continuation-in-part of U.S. patent application Ser. No. 08/749,488 filed on Nov. 15, 1996, which is a continuation-in-part of U.S. patent application Ser. No. 08/603,148 filed on Feb. 15, 1996. Another family of related patent applications assigned to the assignee of the present application include U.S. patent application Ser. No. 08/927,743 filed Sep. 11, 1997, which is a continuation-in-part of U.S. patent application Ser. No. 08/838,133 filed on Apr. 15, 1997, which is a continuation-in-part of U.S. patent application Ser. No. 08/687,149 filed on Jul. 24, 1996, which is a continuation-in-part of U.S. patent application Ser. No. 08/633,225 filed on Apr. 16, 1996.

FIELD OF THE INVENTION

The present invention relates to a closure and neck finish for blow-molded containers and in particular to a snap-on closure with a tamper evident locking feature that can be screwed off the container after initial application and then reapplied by screwing the closure onto the container.

BACKGROUND OF THE INVENTION

Tamper evident caps for containers, such as blow-molded or injection molded containers are well known, see e.g., U.S. Pat. Nos. 4,561,553, 4,625,875, 4,497,765, and 4,534,480. A number of caps are of the snap-on screw-off variety such as U.S. Pat. Nos. 5,553,727, 5,190,178, 5,213,224, 5,267,661, 5,285,912, 5,480,045, 5,456,376, and 5,307,946 and 5,560,504. Generally, the prior art caps include a spiral thread or threads which match a spiral thread on the neck of the bottle. In U.S. Pat. No. 5,307,946 the cap and bottle neck include a seven lead-in end annular spiral thread configuration (or fastening means) and in U.S. Pat. No. 5,553,727 the cap and bottle neck include a ten lead-in end annular spiral thread configuration (or fastening means). The advantage of the multiple lead-in threads is the increased ease of "snap-on" placement of the cap onto the threaded neck using standard bottle capping equipment and without an additional tightening step such as a final twist.

As is apparent from the prior art patents, a great deal of effort has gone into design of cap and bottle neck configurations to provide easy on and off use of the cap by the bottler and ultimately by the end user of the bottled product. However, notwithstanding this effort, the bottling industry continues to search for a cap and neck finish which achieves these objectives but which also provides a secure seal.

The present invention solves this problem by optionally providing at least one annular sealing bead depending from the outer surface of the closure inner annular sealing flange which are compressed against the inner surface of the container neck to form a seal as the closure is snapped onto the container neck. Optionally, sealing engagement between the closure and the mating portions of the exterior wall of the container neck may be further improved by including one or more annular sealing beads on the interior surface of the closure depending annular skirt.

The present invention also solves the problem of protecting the integrity of frangible elements during installation of threaded tamper-evident closures. A plurality of elevated areas extend upwardly from the tamper-evident band in spaced relation to the bottom edge of the closure body. The purpose of these elevated areas is to support the tamper evident band in resisting vertical movement imparted by insertion of the closure on the bottle neck, thereby protecting the frangible elements during assembly. The frangible elements connecting the tamper-evident band to the lower edge of the closure body may be configured to extend from these elevated areas as well as the non-elevated areas of the tamper-evident band. The purpose of attaching frangible elements to the elevated areas of the tamper-evident band is to assist in preventing axial misalignment of the tamper-evident band relative to the annular depending skirt portion of the closure upon subjecting the closure to torquing forces during assembly to the container neck.

At least one and preferably a plurality of circumferentially spaced lugs optionally extend from the exterior wall of the container neck. These lugs facilitate breaidng the frangible elements on the tamper-evident band of the closure by engaging the frangible elements as the closure is twisted off the container neck following initial snap-on application.

Accordingly, it is an object of the present invention to improve sealing engagement between the closure and the mating portions of the interior wall of the container neck by including at least one annular sealing bead depending from the outer surface of the closure inner annular sealing flange which are compressed against the inner surface of the container neck to form a seal as the closure is snapped onto the container neck.

It is a further object of the present invention to improve sealing engagement between the closure and the mating portions of the exterior wall of the container neck by including one or more annular sealing beads on the interior surface of the closure depending annular skirt.

It is a further object of the present invention to provide a lug configuration for facilitating the breakage of frangible elements on the tamper evident band of the closure.

It is a further object of the present invention to provide a threaded tamper-evident closure having frangible elements attached from and between a plurality of elevated areas extending upwardly from the tamper-evident band, for protecting the integrity of frangible elements during installation of the closure on a bottle neck.

SUMMARY OF THE INVENTION

The present invention provides a closure with a thread configuration adapted for snap-on or screw-on application to a container neck finish. Preferably the closure and neck finish contain eight or nine mating continuous or discontinuous threads for this purpose.

The present invention preferably provides at least one annular sealing bead depending from the outer surface of the closure inner annular sealing flange which are compressed against the inner surface of the container neck to form a seal as the closure is snapped onto the container neck. Optionally, sealing engagement between the closure and the mating portions of the exterior wall of the container neck may be further improved by including one or more annular sealing beads on the interior surface of the closure depending annular skirt.

The present invention also preferably provides plurality of elevated areas extend upwardly from the tamper-evident band in spaced relation to the bottom edge of the closure body to support the tamper evident band in resisting vertical movement imparted by insertion of the closure on the bottle neck, thereby protecting the frangible elements during assembly. The frangible elements connecting the tamper-evident band to the lower edge of the closure body may be configured to extend from these elevated areas as well as the non-elevated areas of the tamper-evident band to assist in preventing axial misalignment of the tamper-evident band relative to the annular depending skirt portion of the closure upon subjecting the closure to torquing forces during assembly to the container neck.

At least one and preferably a plurality of circumferentially spaced lugs optionally extend from the exterior wall of the container neck to facilitate breaking the frangible elements on the tamper-evident band of the closure by engaging the frangible elements as the closure is twisted off the container neck following initial snap-on application.

Other advantages of the present invention will become apparent by a perusal of the following detailed description of a presently preferred embodiment of the invention taken in connection with the drawings.

DETAILED DESCRIPTION OF THE PRESENTLY PREFERRED EMBODIMENT

Figure 1:
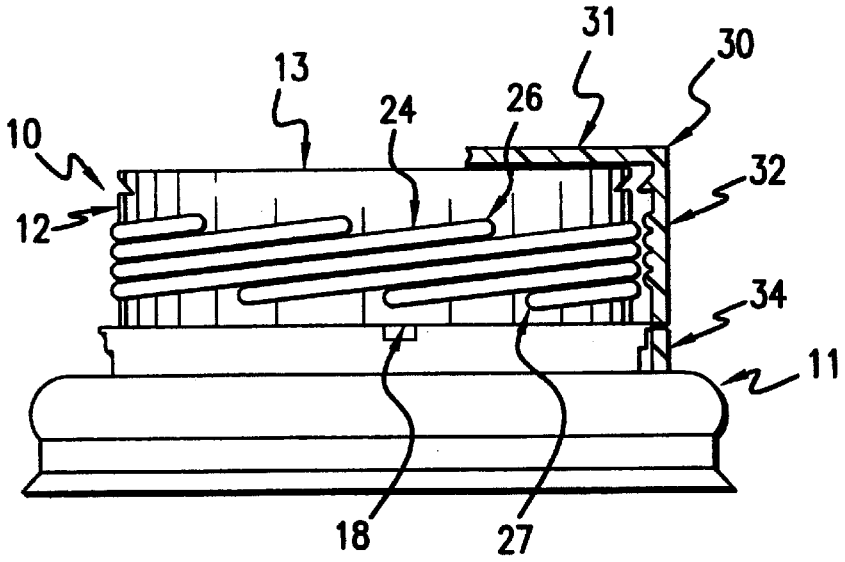
FIG. 1 is an elevation in partial section of a bottle neck finish and closure according to the present invention.
Figure 1A:
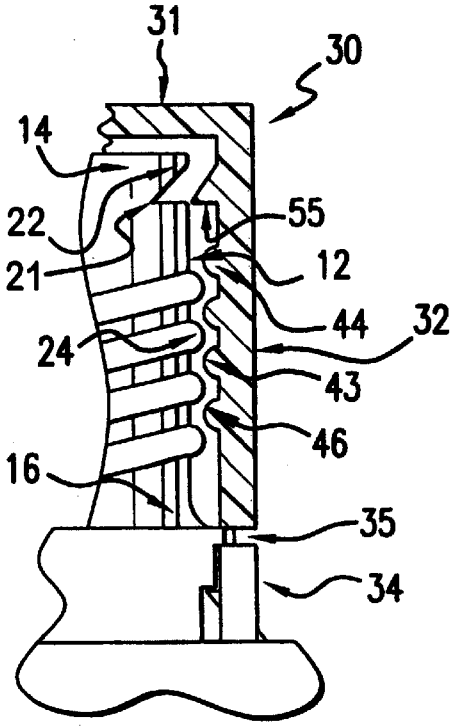
FIG. 1A is an enlarged view of the circumferential mating engagement of the closure and container neck shown in FIG. 1.

Referring to FIGS. 1 and 1A, the neck finish 10 of a container 11 is partially shown. Neck finish 10 is preferably made of plastic and more preferably a high density plastic suitable for blow molding manufacture of the neck finish 10. Neck finish 10 includes an annular wall 12 having a first end 14 and a second end 16 and defining a cylindrical opening 13 within the neck finish 10, with first end 14 providing access to opening 13.

Positioned adjacent to second end 16 is at least one and preferably a plurality of circumferentially spaced lugs 18 projecting from the exterior wall of the container neck. Lugs 18 may be preferably positioned around the entire circumference of the annular wall 12 or alternately only a portion thereof. Lugs 18 facilitate breaking the frangible elements on the tamper-evident band 34 of the closure 30 by engaging frangible elements 35 connecting the tamper-evident band 34 to the closure 30 as the closure 30 is twisted off the container neck 10 following initial snap-on application of the closure 30.

Helically extending between first end 14 and the second end 16 of the annular wall 12 are an appropriate number of threads to permit snap-on or screw-on application, preferably eight or nine threads 24 terminating at points 26 and 27 proximate to the first end 14 and second end 16 of annular wall 12, respectively. Preferably, threads 24 are helically spaced in a continuous relationship as shown in FIG. 1 but threads 24 can alternately be discontinuous and can take on any cross-sectional profile suitable for mating with threads 43 on the closure 30 during snap and screw-on application of the closure 30 to the neck finish 10.

Closure 30 is preferably made from a low or high density polypropylene suitable for blow molding manufacturing. Cap 30 comprises a closure member 31 designed to cover the cylindrical opening 13 of the container neck finish 10. In a preferred embodiment of the invention, closure member 31 is substantially circular and an annular wall 32 circumferentially surrounding at least a portion of neck finish 10 depends from closure member 31.

Figure 2:
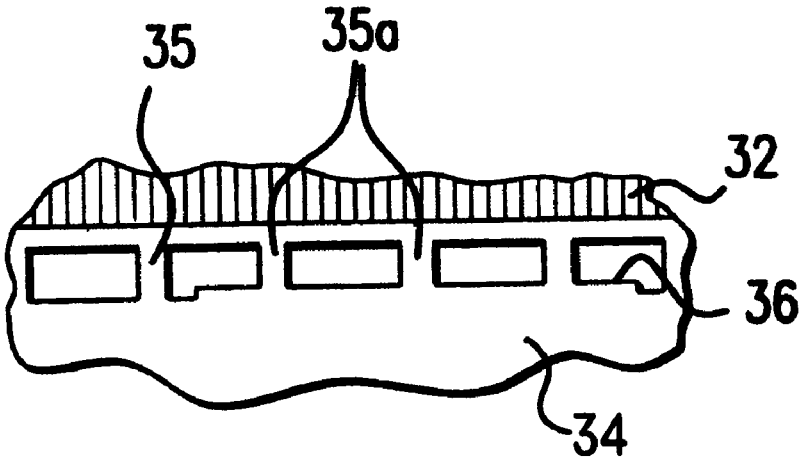
FIGS. 2 and 2A are enlarged sectional views of the tamper-evident band of the closure of the present invention.
Figure 2A:
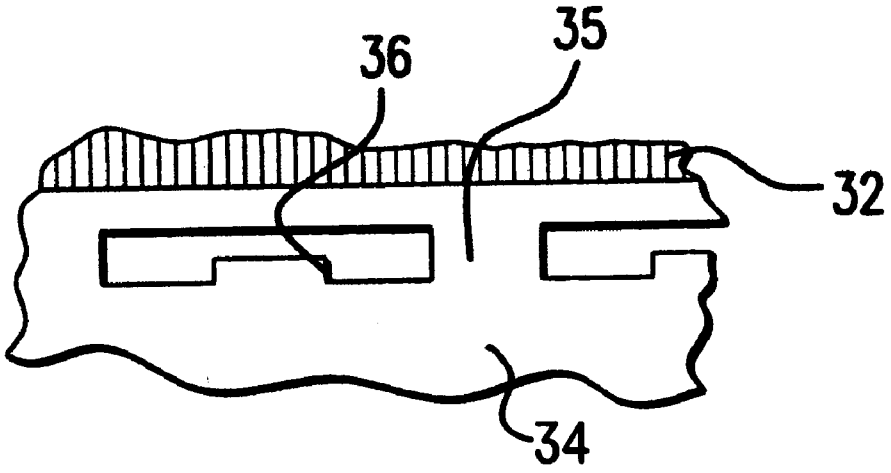

Annular wall 32 includes a tamper-evident band 34 around the end opposite the closure member 31. Tamper-evident band 34 includes at least one and preferably a plurality of frangible elements 35 extending around at least a portion of the circumference of the tamper-evident band 34. As shown in FIGS. 2 and 2A, at least one and preferably a plurality of elevated areas 36 extend upwardly from the tamper-evident band 34 in spaced relation to the bottom edge of annular wall 32. The purpose of these elevated areas is to support the tamper evident band 34 in resisting vertical movement imparted by insertion of the closure on the bottle neck, thereby protecting the frangible elements 35 during assembly. As shown in FIG. 2, the frangible elements 35*a* connecting the tamper-evident band 34 to the lower edge of annular wall 32 may be configured to extend from these elevated areas 36 as well as from the non-elevated areas of the tamper-evident band 34. The purpose of attaching frangible elements to the elevated areas 36 of the tamper-evident band 34 is to assist in preventing axial misalignment of the tamper-evident band 34 relative to the annular wall portion 32 of the closure 30 upon subjecting the closure 30 to torquing forces during snap-on assembly to the container neck finish 10.

Extending from a location proximate to closure member 31 to a location proximate to tamper-evident band 35 are an appropriate number of threads to permit snap-on or screw-on application, preferably eight or nine helically spaced threads 43 on the inner surface of annular depending wall 32 each having respective lead openings 44 and 46. Preferably, closure threads 43 are helically spaced in a continuous relationship as shown in FIG. 1 but threads 43 can alternately be discontinuous and can take on any cross-sectional profile suitable for mating with threads 24 on the container neck finish 10 during snap and screw-on application of the closure 30 to the neck finish 10.

Figure 3:
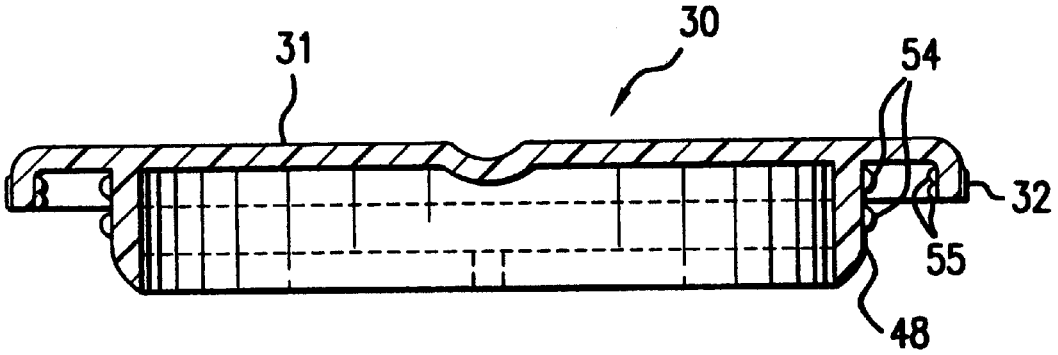
FIG. 3 is a sectional view of the closure sealing flange as it is attached to the closure of the present invention.

As shown in FIG. 3, depending from closure member 31 is depending inner annular sealing flange 48. Inner annular sealing flange 48 is spaced apart from annular depending closure wall 32 a distance which is represented by the difference in the radial distance between the outer surface of the annular neck finish wall 12 and the center of the circumferential opening 13 on the one hand and the radial distance between the inner surface of annular wall 12 and the center of the circumferential opening 13 on the other hand. Preferably inner annular sealing flange 48 includes a taper proximate to its lower edge which permits initial engagement of the inner annular sealing flange 48 to the inner periphery of the neck finish 10 opening upon application of the closure 30 to the neck finish 10. Optionally, inner annular sealing flange 48 contains at least one and preferably a plurality of annular sealing beads 54 depending from the outer surface of the closure inner annular sealing flange which are compressed against the inner surface of the container neck annular wall 12 to form a seal as the closure 30 is snapped onto the container neck 10. Annular sealing beads 54 also contribute to the sealing force of the closure disk 31 against the container neck finish 10 as beads 54 lock beneath corresponding flanges on the inner surface of the container neck 10 (not shown).

Optionally, sealing engagement between the closure 30 and the mating portions of the exterior of the container neck annular wall 12 may be further improved by including one or more annular sealing beads 55 extending around at least a portion of the interior surface of the closure depending annular skirt 32. In the preferred embodiment an annular sealing bead 55 is positioned on annular wall 32 proximate of closure element 31 and is located and dimensioned to engage and cooperatively secure closure 30 to an annular ring flange 22 or groove 21 on neck finish 10 when the cap is snapped onto the neck finish 10.

Cap 30 when used in combination with neck finish 10 of the present invention permits the placement of the cap on the neck finish by snap-on or twist-on application. By preferably utilizing eight or nine threads 24 and 43, it is not necessary to screw the cap on or off the neck. However, by twisting the cap it is possible to obtain an even more secure closure when used by the ultimate consumer, while at the same time providing a leak proof container at the capping station without the necessity of so twisting.

While presently preferred embodiments of the invention have been shown and described in particularity, the invention may be otherwise embodied within the scope of the appended claims.

What is claimed is:

1. A tamper indicating closure configured for snap-on or screw-on application to a container, said closure and container comprising in combination:

a. a closure top portion;

b. an annular depending skirt extending from said top portion, said depending skirt having an internal thread configuration adapted for engaging an external thread configuration on the neck portion of said container by snap-on application during initial installation of said closure to said container neck;

c. an inner annular sealing flange depending from said top portion in spaced relation to said depending skirt; and d. a tamper indicating ring connected to said depending skirt by at least one circumferentially located frangible element;

wherein said container neck contains at least one projection configured for engaging said frangible element(s) to disconnect said closure from said tamper evident band upon twist-off removal of said closure from said container neck.

2. The combination of claim 1, wherein said tamper indicating ring includes at least one annularly spaced elevated area extending axially towards said depending skirt, wherein said at least one elevated area defines a region of decreased ring spacing from said depending skirt.

3. The combination of claim 2, further comprising a plurality of said frangible elements and said elevated areas, wherein at least one of said frangible elements is connected to said depending skin between two said elevated areas.

4. The combination of claim 3, wherein at least one other said frangible element is connected to said depending skirt from an elevated area.

5. The combination of claim 3 wherein said elevated areas extending from said annular ring are of a known vertical height, and said frangible elements are of a height greater than that of said known height of said elevated areas.

6. The combination of claim 4 wherein said elevated areas extending from said annular ring are of a known vertical height, and said frangible elements are of a height greater than that of said known height of said elevated areas.

7. The combination of claim 1, wherein said inner annular sealing flange includes at least one annular sealing bead extending around at least a portion of the circumference of said inner annular scaling flange and being configured for engagement with the interior surface of said container neck finish.

8. The combination of claim 1, wherein said annular depending skirt includes at least one annular sealing bead extending around at least a portion of the circumference of said skirt and being configured for engagement with the exterior surface of said container neck finish.

9. The combination of claim 8, wherein at least one said annular sealing bead engages a sealing bead on the exterior of said container neck finish.

10. The combination of claim 9, wherein said thread configurations contain eight or nine circumferentially spaced individual thread leads.

11. The combination of claim 10, wherein said thread leads are segmented.

12. The combination of claim 8, wherein at least one said one annular sealing bead engages a sealing groove on the exterior of said container neck finish.

13. The combination of claim 12, wherein said thread configurations contain eight or nine circumferentially spaced individual thread leads.

14. The combination of claim 13, wherein said thread leads are segmented.

15. The combination of claim 1, wherein said thread configurations contain eight or nine circumferentially spaced individual thread leads.

16. The combination of claim 15, wherein said thread leads are segmented.

17. The combination of claim 1, wherein said thread configurations contain eight or nine circumferentially spaced individual thread leads.

18. The combination of claim 17, wherein said thread leads are segmented.

* * * * *